US011769617B2

(12) United States Patent
Sakai

(10) Patent No.: US 11,769,617 B2
(45) Date of Patent: Sep. 26, 2023

(54) LAMINATED COIL COMPONENT

(71) Applicant: Murata Manufacturing Co., Ltd., Kyoto-fu (JP)

(72) Inventor: Takashi Sakai, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 420 days.

(21) Appl. No.: 16/985,209

(22) Filed: Aug. 4, 2020

(65) Prior Publication Data

US 2021/0043353 A1 Feb. 11, 2021

(30) Foreign Application Priority Data

Aug. 5, 2019 (JP) ..... 2019-143748

(51) Int. Cl.
*H01F 17/00* (2006.01)
*H01F 17/04* (2006.01)
(Continued)

(52) U.S. Cl.
CPC ..... *H01F 17/0013* (2013.01); *H01F 17/04* (2013.01); *H01F 27/292* (2013.01);
(Continued)

(58) Field of Classification Search
CPC .. H01F 17/045; H01F 27/027; H01F 27/2823; H01F 27/292; H01F 27/306;
(Continued)

(56) References Cited

U.S. PATENT DOCUMENTS

2012/0326827 A1* 12/2012 Nanjyo ..... H01F 17/0033 336/200
2016/0093415 A1* 3/2016 Maeda ..... H01G 4/0085 252/514
(Continued)

FOREIGN PATENT DOCUMENTS

JP H04-65807 A 3/1992
JP 2000-091152 A 3/2000
(Continued)

OTHER PUBLICATIONS

An Office Action; "Notice of Reasons for Refusal," mailed by the Japanese Patent Office dated Mar. 15, 2022, which corresponds to Japanese Patent Application No. 2019-143748 and is related to U.S. Appl. No. 16/985,209 with English language translation.

*Primary Examiner* — Marlon T Fletcher
*Assistant Examiner* — Malcolm Barnes
(74) *Attorney, Agent, or Firm* — Studebaker & Brackett PC

(57) ABSTRACT

A laminated coil component in which the reliability can be improved by suppressing a decrease in the bonding strength between an extended conductor layer and an external electrode. The laminated coil component includes an element body; a coil placed inside the element body and including a plurality of coil conductor layers that are electrically connected; and an external electrode formed on an outer surface of the element body and electrically connected to the coil via an extended conductor layer electrically connected to the coil. The extended conductor layer has an average crystal grain size less than an average crystal grain size of each of the coil conductor layers.

12 Claims, 5 Drawing Sheets

(51) Int. Cl.
*H01F 41/04* (2006.01)
*H01F 27/29* (2006.01)

(52) U.S. Cl.
CPC ... *H01F 41/041* (2013.01); *H01F 2017/0066* (2013.01); *H01F 2017/048* (2013.01)

(58) Field of Classification Search
CPC .. H01F 41/0246; H01F 41/06; H01F 17/0013; H01F 17/04; H01F 41/041; H01F 2017/0066; H01F 2017/048
See application file for complete search history.

(56) References Cited

U.S. PATENT DOCUMENTS

| | | | | |
|---|---|---|---|---|
| 2017/0229221 | A1* | 8/2017 | Okada | H01F 27/2804 |
| 2018/0234074 | A1* | 8/2018 | Lee | H01F 3/10 |
| 2019/0074131 | A1 | 3/2019 | Yamanaka et al. | |
| 2020/0312522 | A1* | 10/2020 | Kurahashi | H01F 27/2804 |

FOREIGN PATENT DOCUMENTS

| | | | | |
|---|---|---|---|---|
| JP | 2000091152 | A | * | 3/2000 |
| JP | 2014160714 | A | * | 9/2014 |
| JP | 2014160714 | A | | 9/2014 |
| JP | 2019-047015 | A | | 3/2019 |

* cited by examiner

LAMINATED COIL COMPONENT

CROSS-REFERENCE TO RELATED APPLICATION

This application claims benefit of priority to Japanese Patent Application No. 2019-143748, filed Aug. 5, 2019, the entire content of which is incorporated herein by reference.

BACKGROUND

Technical Field

The present disclosure relates to a laminated coil component.

Background Art

Japanese Patent Application Laid-Open No. 2014-160714 describes a laminated coil component including an element body, a coil placed in the element body, and an external electrode placed on the outer surface of the element body and connected to the coil via an extended conductor electrically connected to the coil. In the laminated coil component, the extended conductor is exposed from the end face of the element body and is connected to the external electrode at the end face.

SUMMARY

However, when mechanical stress such as bending of the mounting substrate is applied to the laminated coil component, there is a possibility that the bonding strength between the extended conductor layer and the external electrode will decrease. Owing to the decrease in the bonding strength, the contact resistance between the extended conductor layer and the external electrode increases, and the DC resistance of the laminated coil component increases, so that there is a possibility that the reliability will be reduced.

Therefore, the present disclosure provides a laminated coil component in which the reliability can be improved by suppressing a decrease in the bonding strength between an extended conductor layer and an external electrode.

The laminated coil component according to the present disclosure includes an element body; a coil placed inside the element body and including a plurality of coil conductor layers that are electrically connected; and an external electrode formed on an outer surface of the element body and electrically connected to the coil via an extended conductor layer electrically connected to the coil. The extended conductor layer has an average crystal grain size less than an average crystal grain size of each of the coil conductor layers.

According to the present disclosure, it is possible to provide the laminated coil component in which the reliability can be improved by suppressing a decrease in the bonding strength between the extended conductor layer and the external electrode.

DETAILED DESCRIPTION

Hereinafter, embodiments of the present disclosure will be described with reference to the drawings as appropriate. The following description is provided for those skilled in the art to sufficiently understand the present disclosure, and is not intended to limit the present disclosure to the following contents. Furthermore, in the following description, the same reference symbol is given to the configurations that are substantially the same, and a repeat of description will be sometimes omitted.

Figure 1:
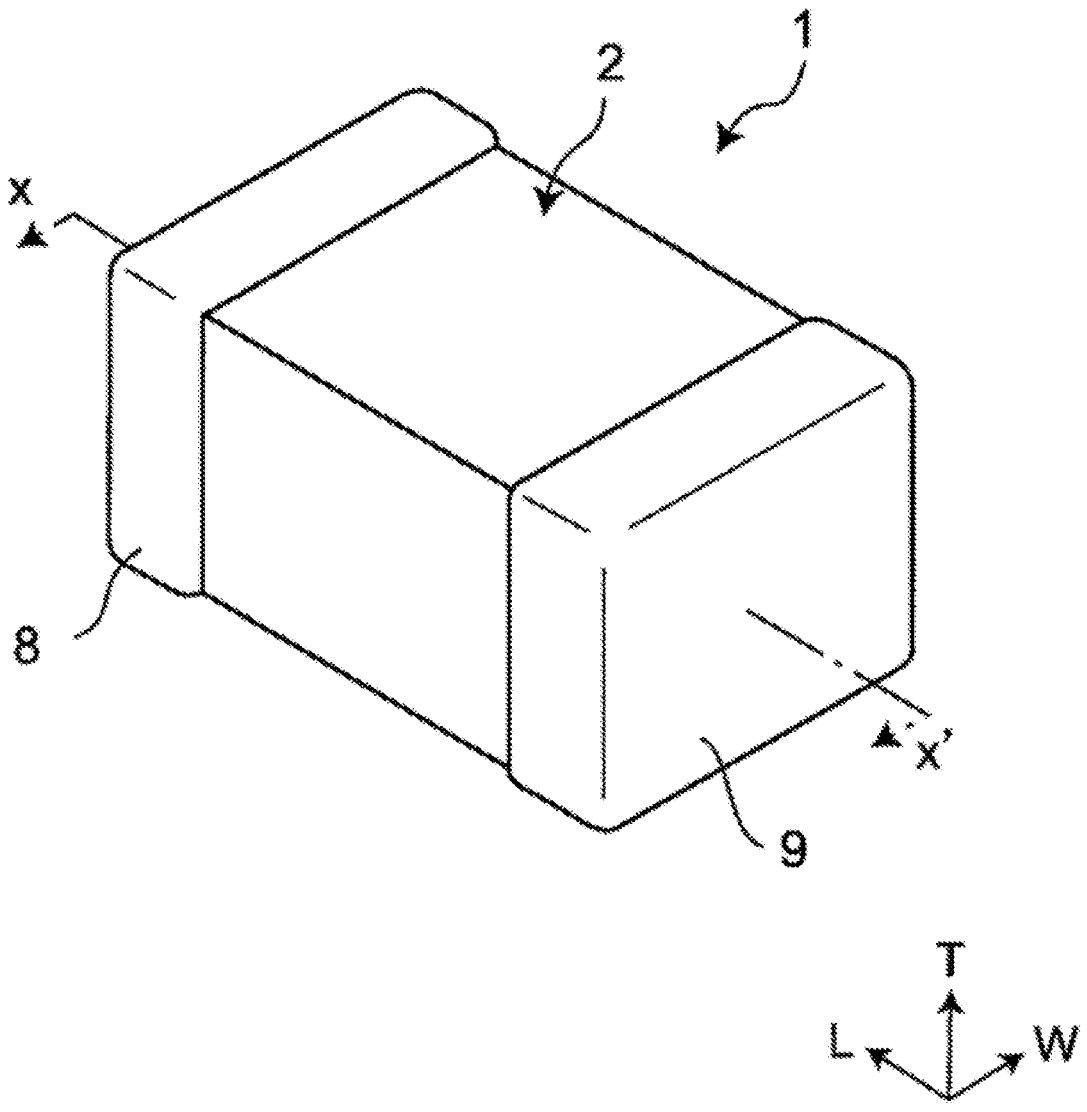
FIG. 1 is a schematic perspective view showing an example of the structure of a laminated coil component according to an embodiment.
Figure 2:
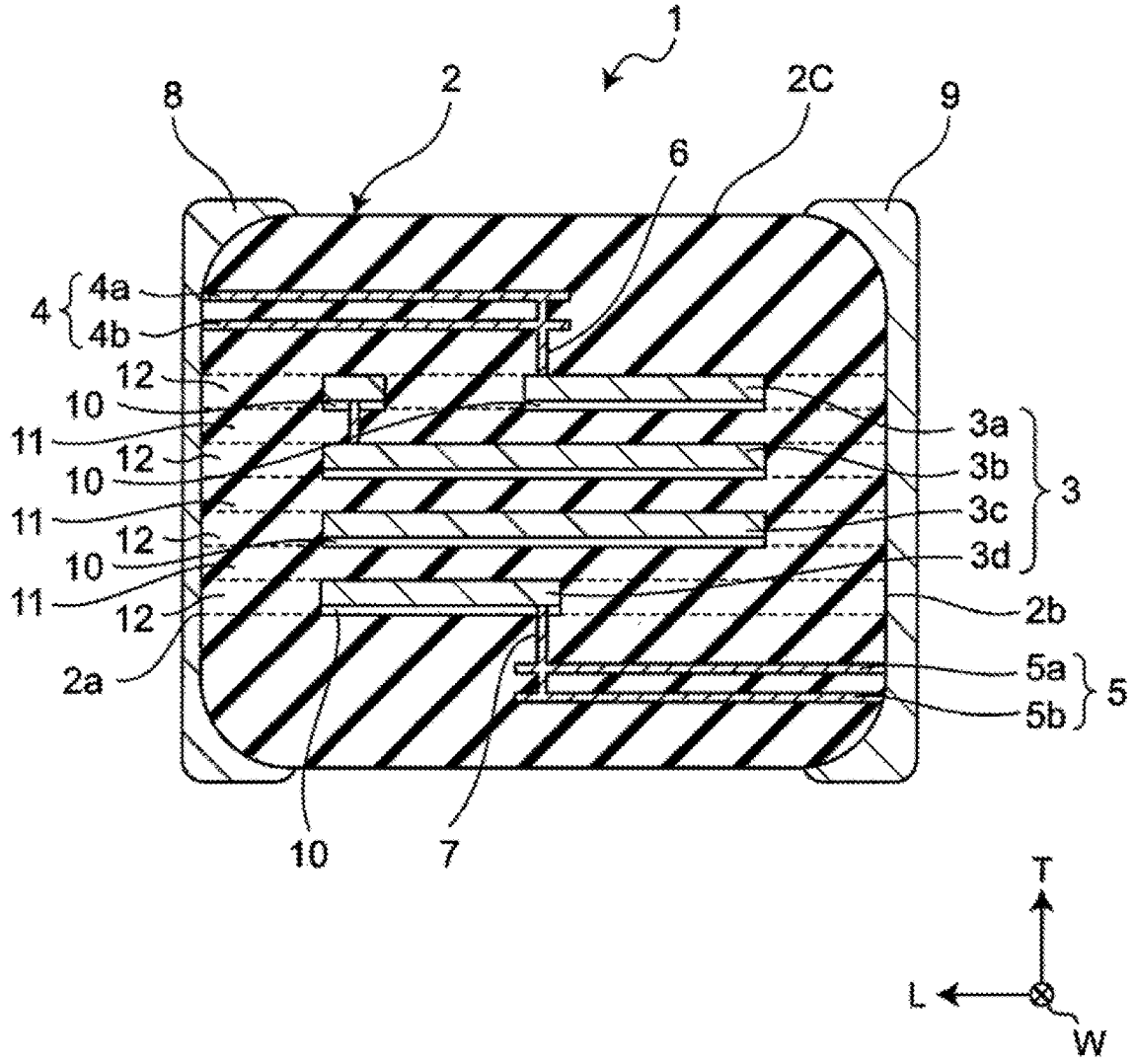
FIG. 2 is a schematic sectional view taken along the line X-X' of the laminated coil component in FIG. 1.
Figure 3:
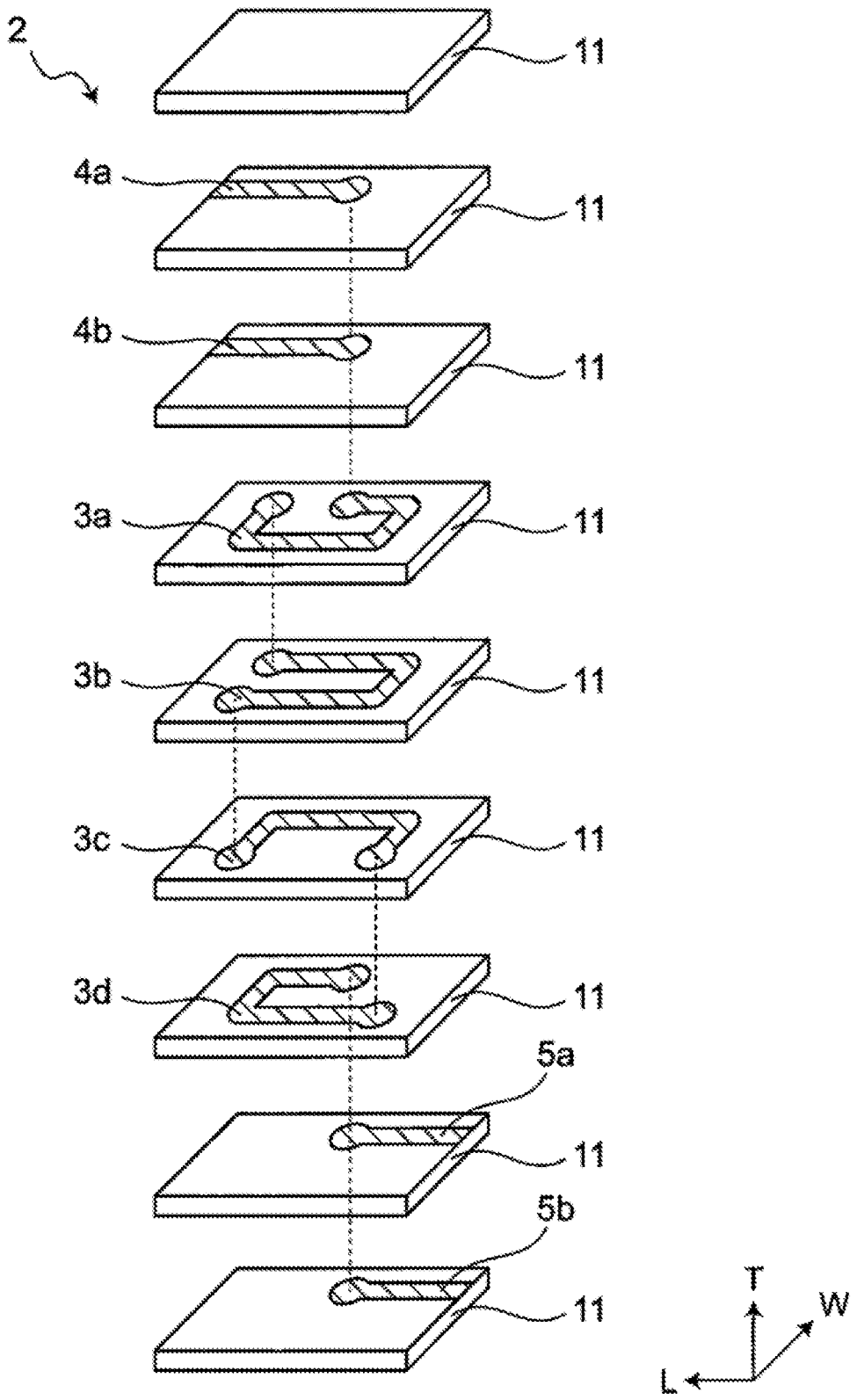
FIG. 3 is an exploded perspective view for illustrating the structure of the laminated coil component in FIG. 1.

FIG. 1 is a schematic perspective view showing an example of the structure of a laminated coil component according to an embodiment. FIG. 2 is a schematic sectional view taken along the line X-X' of the laminated coil component in FIG. 1, and is a sectional view in the LT plane passing through the center along the W axis. FIG. 3 is an exploded perspective view for illustrating the structure of the laminated coil component in FIG. 1, and shows views from the bottom view to the top view along the T axis. The L axis is in the length direction of a laminated coil component 1, the W axis is in the width direction of the laminated coil component 1, and the T axis is in the height direction of the laminated coil component 1 (the first axis).

The laminated coil component 1 includes an element body 2, a coil 3 provided inside the element body 2, and a first external electrode 8 and a second external electrode 9 that are provided on the surface of the element body 2 and electrically connected to the coil 3.

The element body 2 is formed into a substantially rectangular parallelepiped shape. The surface of the element body 2 has a first end face 2*a*, a second end face 2*b* located on the side opposite from the first end face 2*a*, and a side face 2*c* including four sides located between the first end face 2*a* and the second end face 2*b*. The first end face 2*a* and the second end face 2*b* face each other along the L axis. The element body 2 may have a shape with a chamfered corner or ridge.

The first external electrode 8 is electrically connected to a first end of the coil 3, and the second external electrode 9 is electrically connected to a second end of the coil 3. The first external electrode 8 and the second external electrode 9 have a U-shaped section. That is, the first external electrode 8 covers the entire surface of the first end face 2*a* of the element body 2 and the end of the side face 2*c* of the element body 2 on the first end face 2*a* side. The second external electrode 9 covers the entire surface of the second end face 2*b* of the element body 2 and the end of the side face 2*c* of the element body 2 on the second end face 2*b* side. Alternatively, the first external electrode 8 may have an L-shaped section formed over the first end face 2*a* and one side in the side face 2*c*, and the second external electrode 9 may have an L-shaped section formed over the second end face 2*b* and one side in the side face 2*c*.

As shown in FIG. 2, the element body 2 is a laminate in which a plurality of first magnetic layers 11 and second magnetic layers 12 are stacked, and the first magnetic layer 11 and the second magnetic layer 12 are alternately stacked along the T axis. The first magnetic layer 11 and the second magnetic layer 12 include a magnetic material such as a Ni—Cu—Zn-based ferrite material. The first magnetic layer 11 and the second magnetic layer 12 each have a thickness of, for example, 5 μm or more and 30 μm or less (i.e., from 5 μm to 30 μm). The element body 2 may include a nonmagnetic layer in part.

Furthermore, as shown in FIGS. 2 and 3, the coil 3 that is spirally wound along the T axis is placed in the element body 2. A plurality of coil conductor layers 3*a*, 3*b*, 3*c*, and 3*d* are connected in order along the T axis to form a spiral along the T axis. The first end of the coil 3 is electrically connected to two first extended conductor layers 4 (4*a*, 4*b*) via a via conductor 6, and the first extended conductor layer 4 is exposed from the first end face 2*a* of the element body 2 and connected to the first external electrode 8. The second end of the coil 3 is electrically connected to two second extended conductor layers 5 (5*a*, 5*b*) via a via conductor 7, and the second extended conductor layer 5 is exposed from the first end face 2*b* of the element body 2 and connected to the first external electrode 9. Note that in FIG. 3, the external electrodes 8 and 9 and the second magnetic layer 12 are omitted.

In FIGS. 2 and 3, an example is shown in which the numbers of the first extended conductor layers 4 and the second extended conductor layers 5 are each two, but the numbers of the first extended conductor layers 4 and the second extended conductor layers 5 are not particularly limited, and may be, for example, each one. However, it is preferable that the numbers of the layers be each two or more because the reliability of the connection between the external electrode and the extended conductor layer can be further improved when the numbers of the layers are each two or more.

Furthermore, it is preferable that the extended conductor layer be present as a layer other than the coil conductor layer in the laminating direction of the laminate. Although it is also possible to form the extended conductor layer in the same layer as the coil conductor layer by directly connecting the extended conductor layer to the coil conductor layer, by forming the extended conductor layer as a layer other than the coil conductor layer, it is possible to obtain the effect of suppressing the fluctuation in the electrical characteristic even when a plating solution or the like enters.

The plurality of coil conductor layers 3*a*, 3*b*, 3*c*, and 3*d* are each formed into a shape wound on a plane with less than one turn. The first extended conductor layer 4 and the second extended conductor layer 5 are formed into a linear shape. Each coil conductor layer has a thickness of 10 μm or more and 60 μm or less (i.e., from 10 μm to 60 μm), and preferably 10 μm or more and 50 μm or less (i.e., from 10 μm to 50 μm). The first extended conductor layer 4 and the second extended conductor layer 5 have a thickness of 10 μm or more and 60 μm or less (i.e., from 10 μm to 60 μm), and preferably 10 μm or more and 50 μm or less (i.e., from 10 μm to 50 μm), and the thickness may be less than that of the coil conductor layer.

Conventionally, a coil conductor layer and an extended conductor layer are formed by applying a conductive paste containing a metal powder and firing the paste so that the surface of a magnetic layer has a predetermined pattern. In general, when the firing temperature is increased, the sintering of the metal powder proceeds, the crystal grain size increases, and the electrical resistance of the conductor layer decreases. However, when the crystal grain size of the extended conductor layer increases, there is a possibility that the bonding strength between the extended conductor layer and the external electrode will decrease, and the contact resistance will increase. In the present disclosure, from the viewpoint of suppressing the decrease in the bonding strength between the extended conductor layer and the external electrode while low electrical resistance is maintained in the coil conductor layer and the extended conductor layer, the average crystal grain size of the extended conductor layer is less than the average crystal grain size of the coil conductor layer. By reducing the average crystal grain size of the extended conductor layer, bonding points with the external electrode increases, the decrease in the bonding strength between the extended conductor layer and the external electrode is suppressed, and the contact resistance can be reduced. The average crystal grain size of the extended conductor layer is preferably less than the average crystal grain size of the coil conductor layer by 2 μm or more, and more preferably by 3 μm or more. The contact resistance can be further reduced. Furthermore, the average crystal grain size of the extended conductor layer is not particularly limited as long as the average crystal grain size is less than that of the coil conductor layer, and is preferably 2 μm or more and 8 μm or less (i.e., from 2 μm to 8 μm). The average crystal grain size of the coil conductor layer is not particularly limited as long as the average crystal grain size is more than that of the extended conductor layer, and is preferably 4 μm or more and 15 μm or less (i.e., from 4 μm to 15 μm). The conductor grain is Ag, Pd, Pt, Au, or Cu, and preferably Ag or Cu.

The crystal grain sizes of the coil conductor layer and the extended conductor layer can be measured as follows. The section that is an LT plane in the laminated coil component 1 and a plane passing through the center of extended conductor layers 4 and 5 in the laminated coil component 1 along the W axis is subjected to focused ion beam processing (FIB processing). The FIB processing is performed by vertically standing the sample to be measured and, if necessary, solidifying the periphery of the sample with a resin. The section that is an LT plane to be measured can be prepared by polishing the sample with a polishing machine along the W axis of the sample to a depth at which a substantially central portion of the extended conductor layers 4 and 5 is exposed. Here, the FIB processing can be performed using, for example, an FIB processing device SMI3050R manufactured by SII Nano Technology Inc. Then, a scanning electron microscope (SEM) photograph is taken of the prepared section. The obtained SEM photograph is analyzed using image analysis software to determine the average crystal grain sizes of the coil conductor layer and the extended conductor layer. As the image analysis software, "A-zo kun" (registered trademark) manufactured by Asahi Kasei Engineering Corporation can be used.

Furthermore, a void 10 may be present in the element body 2. The void 10 is located between the coil conductor layers 3*a*, 3*b*, 3*c*, and 3*d* and the first magnetic layer 11. The void 10 is provided along the entire surface of the interface between the coil conductor layers 3*a*, 3*b*, 3*c*, and 3*d* and the first magnetic layer 11, and may be provided along a part of the interface. The maximum thickness of the void 10 is, for example, 0.5 μm or more and 8 μm or less (i.e., from 0.5 μm to 8 μm). The void 10 may be located between the coil conductor layers 3*a*, 3*b*, 3*c*, and 3*d* and the second magnetic layer 12.

By providing the void, the stress on the first and the second magnetic layers can be suppressed. The stress is caused by the difference between the thermal expansion coefficients of the coil conductor layer and the first and the second magnetic layers, and is due to the change in the temperature of the coil conductor layer. As a result, the deterioration of the inductance and the impedance characteristics due to the internal stress can be eliminated.

The void can be formed, as described below, by providing a resin portion that can be burned out by firing between the coil conductor layer and the first magnetic layer.

(Method for Manufacturing)

An example of a method for manufacturing a laminated coil component will be described with reference to FIGS. 3 to 5B.

FIGS. 4A-4E corresponds to a section in the width direction of the first magnetic layer in FIG. 3, that is, a TW section.

Figure 4A:
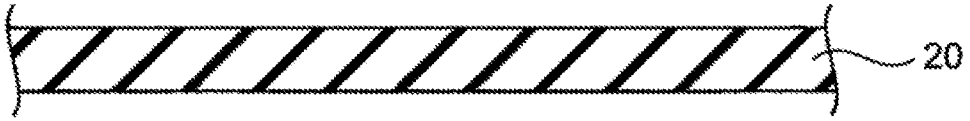
FIGS. 4A-4E are schematic sectional views for illustrating an example of a method for manufacturing the laminated coil component in FIG. 1.

First, a first magnetic sheet 20 including a green sheet (hereinafter abbreviated as a sheet) is prepared (FIG. 4A). The first magnetic sheet 20 is prepared by, for example, molding a magnetic slurry containing a magnetic ferrite material into a sheet shape and, if necessary, processing the sheet-shaped slurry by punching or the like. Examples of the method for processing the magnetic slurry into a sheet shape include a doctor blade method. The obtained sheet has a thickness of, for example, 15 μm or more and 25 μm or less (i.e., from 15 μm to 25 μm). In addition, a predetermined portion in the first magnetic sheet 20 is irradiated with a laser to form a through hole. Note that the first magnetic sheet 20 after firing is the first magnetic layer 11.

The composition of the magnetic ferrite material is not particularly limited, and, for example, a material containing $Fe_2O_3$, ZnO, CuO, and NiO can be used. When the magnetic ferrite material contains $Fe_2O_3$, ZnO, CuO, and NiO, the content of $Fe_2O_3$ is, for example, in the range of 40.0 mol % or more and 49.5 mol % or less (i.e., from 40.0 mol % to 49.5 mol %), the content of ZnO is, for example, in the range of 5 mol % or more and 35 mol % or less (i.e., from 5 mol % to 35 mol %), the content of CuO is, for example, in the range of 8 mol % or more and 12 mol % or less (i.e., from 8 mol % to 12 mol %), and the content of NiO is, for example, in the range of 8 mol % or more and 40 mol % or less (i.e., from 8 mol % to 40 mol %). The magnetic ferrite material can further contain an additive. Examples of the additive include $Mn_3O_4$, $Co_3O_4$, $SnO_2$, $Bi_2O_3$, and $SiO_2$. The magnetic ferrite material is wet-mixed and wet-ground by an ordinary method, and then dried. The resulting dried product is calcined at 700° C. or more and less than 800° C. (i.e., from 700° C. to 800° C.), specifically 700° C. or more and 720° C. or less (i.e., from 700° C. to 720° C.) to form a raw material powder. Note that there is a possibility that the raw material powder (calcined powder) will contain an inevitable impurity. An aqueous acrylic binder and a dispersant are added to the raw material powder, and the mixture is wet-mixed and wet-ground to prepare a magnetic slurry. The wet-mixing and wet-grinding can be performed by, for example, putting in a pot mill together with a partially stabilized zirconia (PSZ) ball.

Figure 4B:
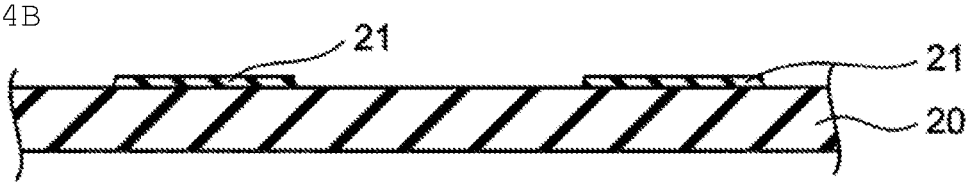

Next, a resin portion 21 is formed on the first magnetic sheet 20 by, for example, screen-printing (FIG. 4B). The resin portion 21 is a portion that can be burned out by firing, and the resin portion 21 is burned out to form a void in the laminated coil component 1. As the material of the resin portion, a paste material containing a resin and a solvent can be used. Examples of the resin include a resin that is burned out during firing, such as an acrylic resin. Examples of the solvent include a solvent that is burned out during firing, such as isophorone.

Figure 4C:
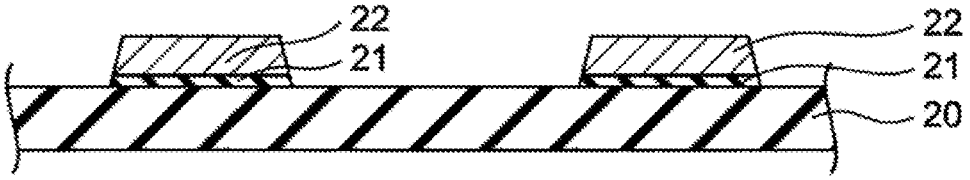

Next, a first conductive paste is screen-printed so that the first conductive paste and the resin portion 21 are stacked, the through hole is filled with the first conductive paste to form a via conductor, and a coil conductor paste layer 22 is formed (FIG. 4C). The coil conductor paste layer 22 can be formed using, for example, the first conductive paste, and specifically, a conductive paste containing an Ag powder, a solvent, a resin, and a dispersant can be used. Examples of the solvent include eugenol, and examples of the resin include an ethyl cellulose. The first conductive paste can be prepared using an ordinary method. For example, the first conductive paste can be prepared by mixing the Ag powder, the solvent, the resin, and the dispersant with a planetary mixer, and then dispersing the mixture with a three-roll mill. Note that the coil conductor paste layer 22 after firing is the coil conductor layer 3.

Figure 4D:
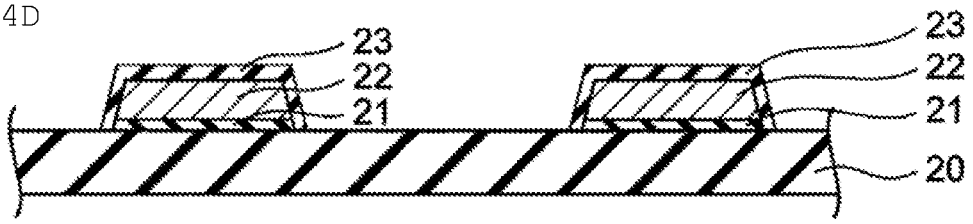

Next, a first magnetic paste layer 23 is formed so as to cover the resin portion 21 and the coil conductor paste layer 22 (FIG. 4D). The first magnetic paste layer 23 is not particularly limited, and can be formed by, for example, screen-printing a first magnetic paste shown below.

The first magnetic paste can be prepared by, for example, kneading a solvent, a raw material powder that is prepared by calcining a magnetic ferrite material, a resin, and a plasticizer with a planetary mixer, and then dispersing the mixture with a three-roll mill. Examples of the solvent include a ketone-based solvent, examples of the resin include polyvinyl acetal, and examples of the plasticizer include an alkyd-based plasticizer. As the magnetic ferrite material and the raw material powder, the same materials as those used for preparing the first magnetic sheet 20 can be used.

Figure 4E:
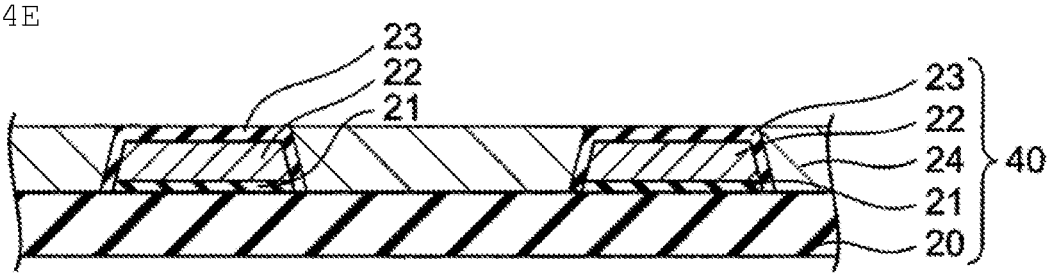

Next, a second magnetic paste layer 24 is formed on the first magnetic sheet 20 so that the second magnetic paste layer 24 and the coil conductor paste layer 22 have the same height (FIG. 4E). The second magnetic paste layer 24 can be formed by screen-printing a second magnetic paste shown below. As a result, a second magnetic sheet 40 including the coil conductor layer can be obtained. Note that the second magnetic paste layer 24 after firing is the second magnetic layer 12.

The second magnetic paste contains a solvent, a raw material powder, a resin, and a plasticizer, and can be prepared by kneading these components with a planetary mixer, and then dispersing the mixture with a three-roll mill. The raw material powder can be prepared by calcining a magnetic ferrite material. As the magnetic ferrite material, the same material as that used for preparing the first magnetic sheet can be used. The calcined magnetic ferrite material can be prepared by wet-mixing and wet-grinding in which an ordinary method is used, and then drying the resulting product, and calcining the resulting dried product at 800° C. or more and 820° C. or less (i.e., from 800° C. to 820° C.). Note that there is a possibility that the raw material powder will contain an inevitable impurity.

Figure 5A:
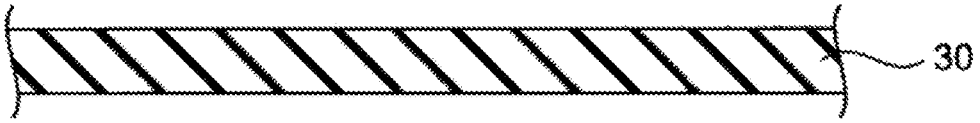
FIGS. 5A and 5B are schematic sectional views for illustrating an example of a method for manufacturing the laminated coil component in FIG. 1.
Figure 5B:
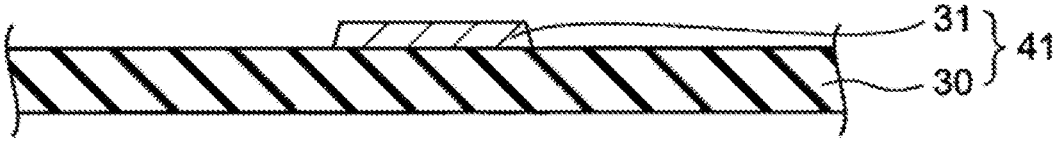

Next, another first magnetic sheet 30 is prepared (FIG. 5A). A predetermined portion in the prepared first magnetic sheet 30 is irradiated with a laser to form a through hole, and by screen-printing a second conductive paste, the through hole is filled with the second conductive paste to form a via conductor, and an extended conductor paste layer 31 is formed (FIG. 5B). As a result, a third magnetic sheet 41 including the extended conductor layer can be obtained. Note that the extended conductor paste layer 31 after firing is the extended conductor layer 4 or 5.

The second conductive paste contains 100 parts by weight of an Ag powder and a ceramic powder that serves as a sintering inhibitor. The sintering inhibitor suppresses the sintering of the metal powder contained in the conductive paste during firing, and $Al_2O_3$ or $ZrO_2$ can be used when Ag is used as the conductive metal material. With the sintering inhibitor, the growth of an Ag grain can be suppressed. As a result, the average crystal grain size of the Ag grain in the extended conductor layer 4 or 5 can be less than that in the coil conductor layer 3. When an Ag powder is used as the metal powder, the amount of the sintering inhibitor is 0.2 parts by weight or more and 1.0 part by weight or less (i.e., from 0.2 parts by weight to 1.0 part by weight), and preferably 0.3 parts by weight or more and 0.9 parts by weight or less (i.e., from 0.3 parts by weight to 0.9 parts by weight) based on 100 parts by weight of the Ag powder. This is because when the amount is more than 1.0 part by weight, the sintering rarely occurs, and when the amount is less than 0.2 parts by weight, the effect of reducing the crystal grain size is not sufficient.

Next, a plurality of the prepared first magnetic sheets 20, second magnetic sheets 40, and third magnetic sheets 41 are stacked in a predetermined order and subjected to thermal pressure bonding to prepare a laminate. Here, in the exploded perspective view in FIG. 3, one first magnetic sheet 20 corresponds to the uppermost first magnetic layer 11 after firing, four second magnetic sheets 40 correspond to four first magnetic layers 11 after firing that respectively have a coil conductor layer 3*a*, 3*b*, 3*c*, or 3*d*, and four third magnetic sheets 41 correspond to four first magnetic layers 11 that respectively have an extended conductor layer 4*a*, 4*b*, 5*a*, or 5*b*.

Next, the prepared laminate is subjected to an ordinary operation such as separation, firing, or formation of an external electrode to prepare a laminated coil component 1. The separation, the firing, and the formation of an external electrode can be performed using an ordinary method. For example, the separation can be performed by cutting the obtained laminate with a dicer or the like. If necessary, a rotary barrel can be used to chamfer the corner and the ridge. The firing can be performed at a temperature of 880° C. or more and 920° C. or less (i.e., from 880° C. to 920° C.). The formation of an external electrode can be performed by immersing the end face with the exposed extended conductor layer in a layer in which a conductive paste is extended to a predetermined thickness, baking the end face at a temperature of about 800° C. to form a base electrode, and then forming a Ni film and a Sn film in order on the base electrode by electrolytic plating.

EXAMPLES

Hereinafter, the present disclosure will be described in more detail with reference to Examples.

Example 1

A laminated coil component was prepared using the method for manufacturing described in the embodiment. Specifically, as the magnetic ferrite material of the first magnetic sheet, a material containing 48.0 mol % of $Fe_2O_3$, 22.0 mol % of ZnO, 22.0 mol % of NiO, and 8.0 mol % of CuO was used. Furthermore, as the first conductive paste, a silver paste containing no sintering inhibitor was used to form a coil conductor layer, and as the second conductive paste, a silver paste containing 0.2 parts by weight of $Al_2O_3$ as a sintering inhibitor based on 100 parts by weight of an Ag powder was used to form an extended conductor layer. A plurality of the prepared first magnetic sheets, second magnetic sheets, and third magnetic sheets were stacked in a predetermined order and subjected to thermal pressure bonding to prepare a laminate. The laminate was separated with a dicer and then fired at 910° C. An external electrode was prepared by immersing the end face with the exposed extended conductor layer in a layer in which a silver paste is extended to a predetermined thickness, baking the end face at a temperature of about 800° C. to form a base electrode, and then forming a Ni film and a Sn film in order on the base electrode by electrolytic plating.

Comparative Example 1

A laminated coil component was prepared in the same manner as in Example 1 except that the extended conductor layer was formed using the first conductive paste.

(Method for Calculating Average Crystal Grain Size)

The section that is an LT plane in the prepared laminated coil component and a plane passing through the center of extended conductor layer in the laminated coil component along the W axis was subjected to focused ion beam processing (FIB processing). The FIB processing was performed by vertically standing the sample to be measured and solidifying the periphery of the sample with a resin. The section that is an LT plane to be measured was prepared by polishing the sample with a polishing machine along the W axis of the sample to a depth at which a substantially central portion of the extended conductor layer was exposed. The FIB processing was performed using an FIB processing device SMI3050R manufactured by SII Nano Technology Inc. Then, a scanning electron microscope (SEM) photograph was taken of the prepared section (the area having a size of 30 μm×30 μm). The obtained SEM photograph was analyzed using image analysis software ("A-zo kun" (registered trademark) manufactured by Asahi Kasei Engineering Corporation) to determine the average crystal grain sizes of the coil conductor layer and the extended conductor layer. The results are shown in Table 1.

TABLE 1

| | Average crystal grain size of coil conductor layer (μm) | Average crystal grain size of extended conductor layer (μm) |
|---|---|---|
| Example 1 | 7.9 | 3.8 |
| Comparative Example 1 | 7.9 | 7.9 |

As shown in Table 1, according to Example 1, the average crystal grain size (μm) of the extended conductor layer was 3.8 μm, so that it was possible to reduce the average crystal grain size to about half of that in Comparative Example 1. As a result, the improvement in the bonding strength can be expected between the extended conductor layer and the external electrode.

The laminated coil component according to the present disclosure can be used in, for example, electronic devices such as personal computers, DVD players, digital cameras, TVs, mobile phones, and car electronics as a noise removal filter.

What is claimed is:

1. A laminated coil component comprising:

an element body;

a coil provided inside the element body and including a plurality of coil conductor layers that are electrically connected; and an external electrode disposed on an outer surface of the element body and electrically connected to the coil via an extended conductor layer electrically connected to the coil, and wherein an average crystal grain size of the extended conductor layer is less than an average crystal grain size of each of the coil conductor layers, the extended conductor layer is I-shaped and extends only in a single direction, and the average crystal grain size of the extended conductor layer is less than the average crystal grain size of each of the coil conductor layers by 2 μm or greater.

2. The laminated coil component according to claim 1, wherein the average crystal grain size of the extended conductor layer is from 2 μm to 8 μm.

3. The laminated coil component according to claim 1, wherein the average crystal grain size of each of the coil conductor layers is from 4 μm to 15 μm.

4. The laminated coil component according to claim 1, wherein the element body has a void in contact with each of the coil conductor layers.

5. The laminated coil component according to claim 1, wherein the element body is a laminate in which a plurality of magnetic layers are laminated, and the extended conductor layer is located at a different layer than each of the coil conductor layers in a laminating direction of the laminate.

6. The laminated coil component according to claim 5, wherein the extended conductor layer includes at least two layers.

7. The laminated coil component according to claim 2, wherein the average crystal grain size of each of the coil conductor layers is from 4 μm to 15 μm.

8. The laminated coil component according to claim 2, wherein the element body has a void in contact with each of the coil conductor layers.

9. The laminated coil component according to claim 3, wherein the element body has a void in contact with each of the coil conductor layers.

10. The laminated coil component according to claim 2, wherein the element body is a laminate in which a plurality of magnetic layers are laminated, and the extended conductor layer is located at a different layer than each of the coil conductor layers in a laminating direction of the laminate.

11. The laminated coil component according to claim 3, wherein the element body is a laminate in which a plurality of magnetic layers are laminated, and the extended conductor layer is located at a different layer than each of the coil conductor layers in a laminating direction of the laminate.

12. The laminated coil component according to claim 4, wherein the element body is a laminate in which a plurality of magnetic layers are laminated, and the extended conductor layer is located at a different layer than each of the coil conductor layers in a laminating direction of the laminate.

* * * * *